US009746295B1

(12) United States Patent
Manole et al.

(10) Patent No.: US 9,746,295 B1
(45) Date of Patent: Aug. 29, 2017

(54) 40 MM EXTENDED RANGE HIGH PERFORMANCE PROJECTILE WITH ROCKET AND GUIDANCE NAVIGATION CONTROL CAPABILITY AND DECOUPLING DEVICE

(71) Applicants: Leon Manole, Great Meadows, NJ (US); Wilfredo Toledo, Hasbrouck Heights, NJ (US); Arthur Ricardo Pizza, Maywood, NJ (US); Ronny Alzamora, Belleville, NJ (US); Gary Anthony Pacella, Stroudsburg, PA (US)

(72) Inventors: Leon Manole, Great Meadows, NJ (US); Wilfredo Toledo, Hasbrouck Heights, NJ (US); Arthur Ricardo Pizza, Maywood, NJ (US); Ronny Alzamora, Belleville, NJ (US); Gary Anthony Pacella, Stroudsburg, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/870,712

(22) Filed: Sep. 30, 2015

Related U.S. Application Data

(63) Continuation-in-part of application No. 14/589,326, filed on Jan. 5, 2015, now Pat. No. 9,194,675, which is a continuation-in-part of application No. 13/761,861, filed on Feb. 7, 2013, now abandoned.

(60) Provisional application No. 62/064,048, filed on Oct. 15, 2014, provisional application No. 61/601,609, filed on Feb. 22, 2012.

(51) Int. Cl.

| | |
|---|---|
| ***F42B 14/02*** | (2006.01) |
| ***F42B 12/02*** | (2006.01) |
| ***F42B 14/06*** | (2006.01) |
| ***F42B 15/01*** | (2006.01) |

(52) U.S. Cl.
CPC ..... *F42B 12/02* (2013.01); *F42B 14/02* (2013.01); *F42B 14/06* (2013.01); *F42B 15/01* (2013.01)

(58) Field of Classification Search
CPC ..... F42B 14/02; F42B 14/04; F42B 14/067
USPC ..... 102/473, 439, 483, 524, 526, 527, 444, 102/529, 445
See application file for complete search history.

(56) References Cited

U.S. PATENT DOCUMENTS

| | | | | | |
|---|---|---|---|---|---|
| 4,552,071 | A * | 11/1985 | Horais | F42B 14/02 | 102/524 |
| 4,748,912 | A * | 6/1988 | Garcia | F42B 30/10 | 102/372 |
| 4,833,995 | A * | 5/1989 | Gotz | F42B 10/06 | 102/521 |
| 5,773,751 | A * | 6/1998 | Fredriksson | F42B 14/02 | 102/293 |
| 6,588,700 | B2 * | 7/2003 | Moore | F42B 10/14 | 102/473 |

(Continued)

*Primary Examiner* — Reginald Tillman, Jr.
(74) *Attorney, Agent, or Firm* — Michael C. Sachs

(57) ABSTRACT

An extended range, enhanced lethality 40 mm ammunition round. The round features controlled guidance and camera front end, which can be fired as fin stabilized with no appreciable spin, from an M320 grenade launcher. The round has a launching sleeve with an oversized propellant cup, to essentially double or triple conventional range, with sharp accuracy provided by the guidance system.

10 Claims, 6 Drawing Sheets

(56) References Cited

U.S. PATENT DOCUMENTS

2009/0145323 A1* 6/2009 Gustavsson ..... F42B 14/02
102/524

* cited by examiner

40 MM EXTENDED RANGE HIGH PERFORMANCE PROJECTILE WITH ROCKET AND GUIDANCE NAVIGATION CONTROL CAPABILITY AND DECOUPLING DEVICE

CROSS REFERENCE TO RELATED APPLICATIONS

This application claims benefit under 35 USC§119 (e) from provisional application 62/064,048 filed Oct. 15, 2014, the entire file wrapper contents of which is hereby incorporated by reference as though fully set forth. Additionally, this application is a continuation-in-part of commonly assigned application Ser. No. 14/589,326 filed Jan. 5, 2015 (2012-006 CIP), continuing from application Ser. No. 13/761,861 filed Feb. 7, 2013, which latter application in itself claims benefit under 35USC§119 (e) from provisional application 61/601,609 filed Feb. 22, 2012.

U.S. GOVERNMENT INTEREST

The inventions described herein may be made, used, or licensed by or for the U.S. Government for U.S. Government purposes.

BACKGROUND OF INVENTION

The 40 mm M320 grenade launcher has been fielded and is expected to replace the M203 launcher. The M320 allows for use of the new family of 40 mm low velocity ammunition described herein, developed to meet new user needs. It is desired to launch projectile(s) from conventional battlefield M203 or M320 grenade launcher(s) but with a lack of projectile spinning that will then make it possible to further install camera/guidance equipment at the front of the projectile that would ordinarily not function on a rapidly spinning projectile. An M203 or M320 grenade launcher however has internal rifling which always would engage and spin up such a projectile during launch. This ammunition round will allow a projectile to be launched from a conventional battlefield M203 or M320 grenade launcher, but with a lack of projectile spinning. This is not otherwise possible, conventionally.

A feature of this ammunition round is a joint area with an obturator means that is free to spin. This can spin decouple the projectile from the rifling action of the launcher. Then, the parts of the ammunition round that the M203 or M320 grenade launcher's internal rifling can engage and spin up are only on such obturator means. Because the projectile is of a smaller diameter than the obturator means, the projectile cannot be engaged or be spun up by the M203 or M320 grenade launcher's internal rifling. Even if the obturator means were to be spun up by the M203 or M320 grenade launcher's internal rifling yet the actual projectile would not be spun up. This is what is sought. This lack of projectile spinning makes it possible to further install camera/guidance equipment in the front of the projectile which would ordinarily not function on a rapidly spinning projectile. That added camera/guidance equipment could then further convert a regular 40 mm projectile into a smart, very accurate long distance projectile, and the camera/guidance equipment could certainly now be employed as is desired.

Another feature of particular note is a new ammunition round that can be launched with varying degrees of spin rate as well as with no spin at all, from the M320 by canting of rear fins on the projectile. The slowed down rate of spin also can make possible the use of frontal guidance and cameras ordinarily not possible with a rapidly spinning round which would ordinarily be the case when launched from an M320 due to internal rifling in the M320. So, this new ammunition round has a unique combination of slipping obturator ring(s) and also fins which can also be selectively canted at desired angles for low selectable spin rates.

BRIEF SUMMARY OF INVENTION

This invention allows for a novel 40 mm low velocity projectile with aerodynamic shape for improved flight, with Guidance Navigation and Control (GNC) capability for course correction during flight, visual real time feedback of flight to target, optional decoupling of projectile front end for camera clarity, prepositioned fins so there are no moving fin parts that can go wrong in launch and flight, novel electronics for autopilot flight, and an optional proximity fuze with explosive fill for target destruct.

OBJECTS OF THE INVENTION

Accordingly, it is an object of the present invention to provide an extended range, enhanced lethality 40 mm ammunition round which can be fired from an M320 grenade launcher.

Another object of the present invention is to provide an ammunition round which can be fired as fin stabilized, with no appreciable spin, from an M320 grenade launcher.

It is a further object of the present invention to provide an ammunition round which can be fired from an M320 grenade launcher which round has stationary fins that can be canted to select for its spin rate after exiting from the grenade launcher.

It is yet another object of the present invention to provide an ammunition round which can be fired from an M320 grenade launcher, which round features a controlled guidance and camera in its front end.

It is a still other object of the present invention to provide an ammunition round which can be fired from an M320 grenade launcher, which has great accuracy provided by such up-front guidance system.

It is a further object of the present invention to provide an ammunition round which can be fired from an M320 grenade launcher employing a launching sleeve with an oversized propellant cup.

It is a still further object of the present invention to provide an ammunition round which can be fired from such M320 grenade launcher with an essentially double or triple conventional range.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION OF THE INVENTION

Figure 1:
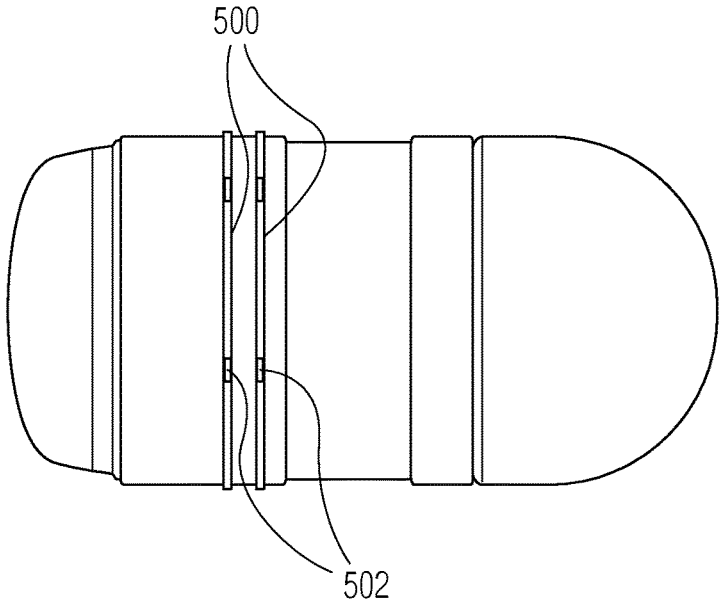
FIG. 1 PRIOR ART
FIG. 1 illustrates a conventional 40 mm Low velocity M433 inert fill projectile, which had been fired and recovered. It might have been fired from an M203 or M320 grenade launcher.

FIG. 1 illustrates a 40 mm Low velocity M433 inert fill projectile, which had been fired and recovered. It might be fired from an M203 or M320 grenade launcher. The M203 and M320 grenade launcher weapons incorporate rifling to spin up the projectile since spin is a necessary element for the projectile to have a stable flight. Note the rifling grooves shown at 500 here with notches such as 502 caused by engagement with internal rifling of the gun in this M433 projectile. The rifling from the launcher provides the projectile with the spin ordinarily necessary for stabilizing the munition in flight.

Figure 2:
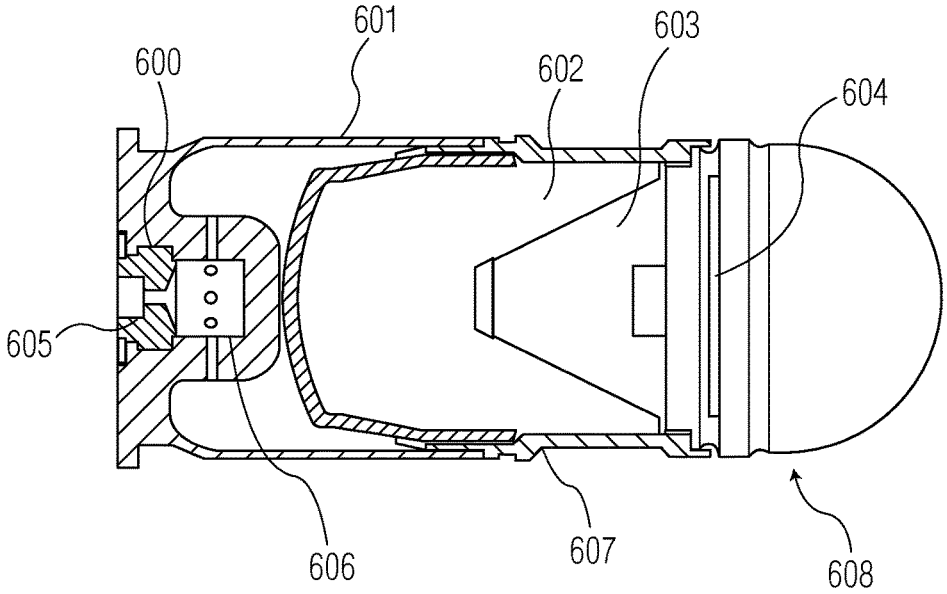
FIG. 2 PRIOR ART
FIG. 2 is a cutaway view of the conventional M433 projectile of FIG. 1 being held in its M118 cartridge case (601).

FIG. 2 is a cutaway view of such M433 projectile being held in its M118 cartridge case (601). The view shows the space budget and inner components of such M433 High Explosive Dual Purpose cartridge. A base plug is shown at 600, explosive composition A5 is shown at 602, a copper liner is shown at 603, a spitback assembly is shown at 604, a percussion primer M42 or FED-100 is shown at 605, an M9 propelling charge is shown at 606, a cup and liner loading assembly is shown at 607 and an M550 PIBD fuze is shown at 608.

This projectile was originally designed to be fired from a M203 grenade launching weapon. The M433 projectile of FIG. 1 is able to travel approximately 400 meters with an effective range of 200 to 250 meters if accuracy is needed. Beyond 250 meters projectile wobbling increases, making it difficult to hit targets. What is needed is a better 40 mm low velocity projectile that can be utilized by a M320 grenade launcher gun to increase range, have provisions to incorporate Guidance, Navigation and Control (GN&C), be easy to manufacture without needing to include moving means to further deploy fins for stabilizing, have an increased volume projectile body which can carry additional cargo and components, while also taking advantage of the M320's weapon loading configuration that can accommodate longer projectiles.

Figure 3:
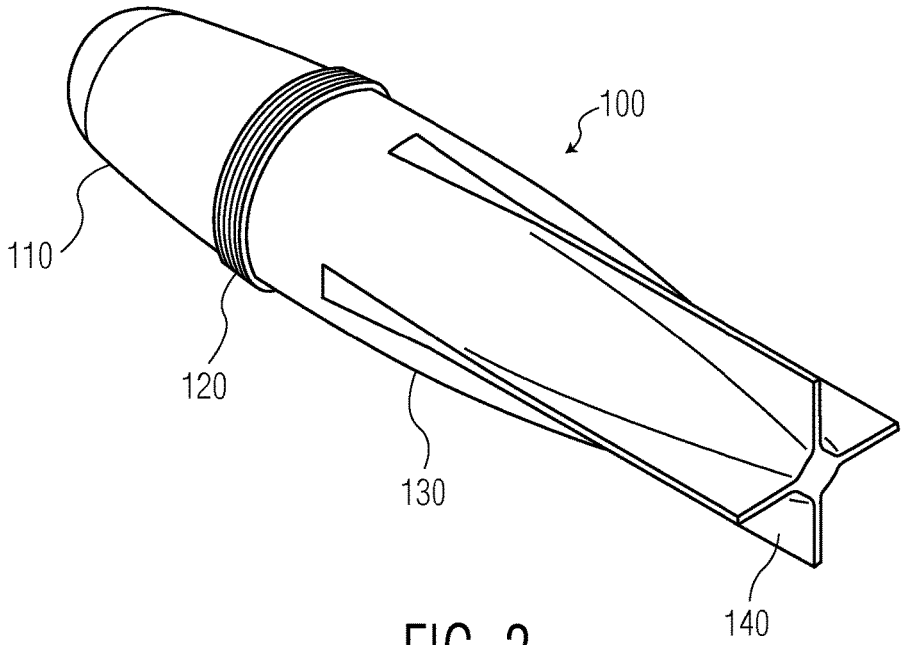
FIG. 3 is a model of a new 40 mm extended range high performance projectile according to the invention with rocket and guidance navigation and control (GN&C) capability.
Figure 6:
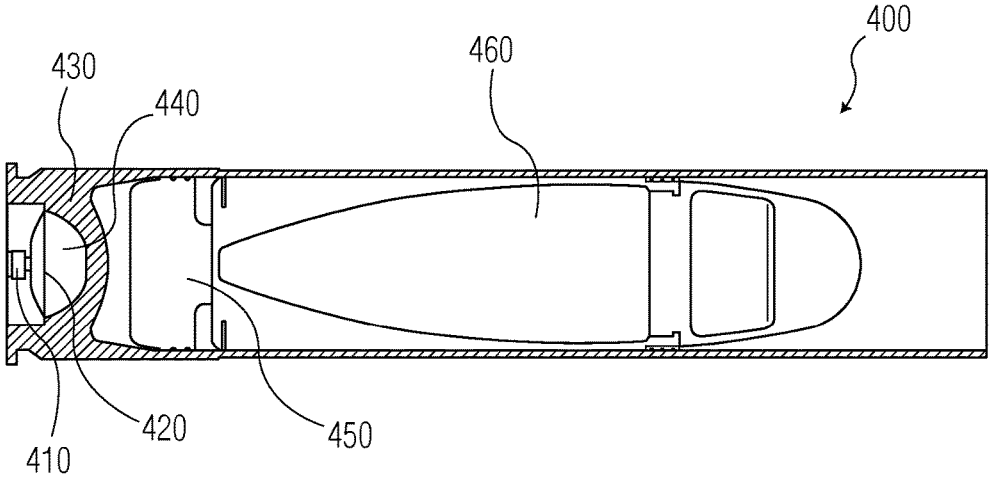
FIG. 6 is a cutaway model of another new 40 mm extended range high performance projectile (460) according to the invention, fully loaded into cartridge case/sleeve (430), and ready to be fired from an M320 launcher device.

FIG. 3 is a model of a new 40 mm Extended Range High Performance projectile (100) with Rocket and Guidance navigation and Control (GN&C) Capability. The front head of the projectile (110) can be made of multiple materials including copper, aluminum, steel and/or pre-stressed metals for fragmentation capability. The obturator and/or optional decoupling device, and/or anti balloting device (120), serves several functions. Further detail of device 120 can be seen later below at FIGS. 7A-7H where there is a spinner 708 described which very generally could be used for device 120. Device (120) may be made of metals, plastics or composites. It is also used to hold projectile (100) into a cartridge case sleeve as shown in FIG. 6 here below. The body (130) is threaded into the projectile head (110) with obturator device (120) sitting in a seat between the head (110) and the body (130). The body of the projectile (130) can also be made of multiple materials including copper, aluminum, steel and/or pre-stressed metals for fragmentation capability. The widest diameter part on the entire round is device 120, so made so that it should be the only part on the overall round to engage with the internal rifling in the grenade launcher gun. Because device 120 spins freely for 360 degrees around the longitudinal axis of the round, it will be appreciated that the round proper will not be spun up in launching by the internal rifling in the grenade launcher gun, only device 120 will spin. Otherwise, the overall shape of the round here can resemble a small "football" or a small "blimp like" shape, including fins, noting that no other parts of the round will engage the gun's rifling other than device 120 here. Body 130 contains fins 140 that likewise can be made of multiple materials including copper, aluminum, steel and/or pre-stressed metals for fragmentation capability. The fin assembly 140 can have 2-8 fins depending on aero ballistic balance of the projectile 100. The most common projectile will have 4, 6 or 8 fins. The choice of the number of fins as 4, 6 or 8 depends on locating the center of gravity of the fully functioning projectile and the stability needed with a guided projectile. Tested projectiles 100 were able to travel 800 meters with excellent flight characteristics. This would effectively double the range compared to a standard M433 and might even be four times its effective range. The fins 140 can be utilized as stationary with no cant to provide aero-ballistic stability with no spin, or else selectively canted to allow the projectile to also spin to a predetermined rate, while also still being fin stabilized in flight. This round was demonstrated to 800 meters without spin. The advantage in having a non-spinning projectile 100 is that this allows for a camera system or Semi-active Laser (SAL) designator to be used for purposes of GN&C.

Figure 4:
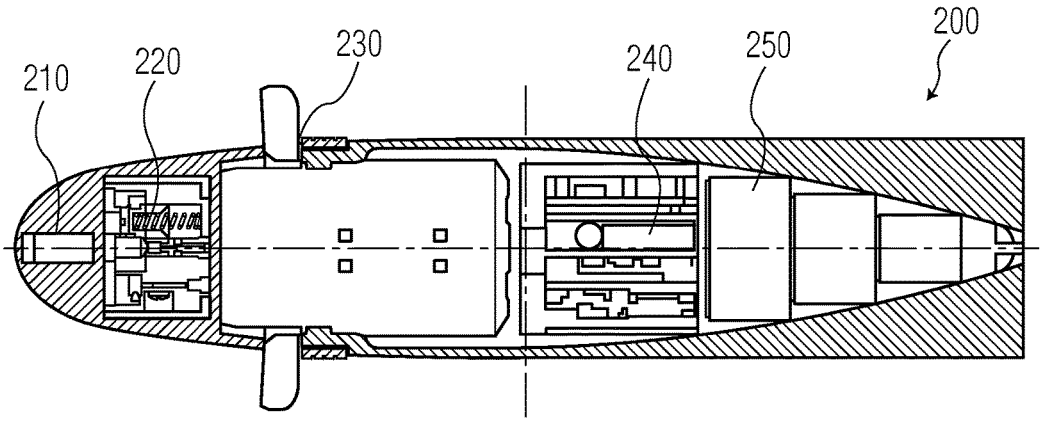
FIG. 4 is a cutaway model of a new 40 mm extended range high performance projectile according to the invention with rocket and guidance navigation and control (GN&C) capability detailing an increased cargo area and ability to incorporate a variety of new components.

FIG. 4 is a cutaway model of a new 40 mm Extended Range High Performance projectile with Rocket and Guidance Navigation and Control (GN&C) Capability detailing the increased cargo area and ability to incorporate a variety of new components. A possible rocket assist option, is not shown in FIG. 4. The front of projectile (200) may contain a camera (210) to send back real time flight information so that a user with a computer can guide the projectile, or it may contain a SAL (not shown) to help direct the projectile to target. The Canard Activation System (CAS), 230, is one method of guiding the projectile to target using the electronics (240) that contain algorithms and a flight computer or autopilot. The CAS canards are programmed to move in certain positions therefore causing the projectile to move up, down, or sideways, as needed.

Fuze (220) may contain proximity or timing devices to enhance its user potential and target destruct capability. An energetic (250) is shown in projectile (200). All the components in the space budget shown may be altered in position and size and amount in order to provide user needed capability and enhance aero ballistic flight. Projectile (200) may be from 2-7 inches in length, depending on user need. Weights, distances and airframe may be adjusted to accommodate user and mission needs. The exterior shape of the projectile (200) may be changed to meet aerodynamic optimization and to accommodate the most optimal space budget.

Figure 5:
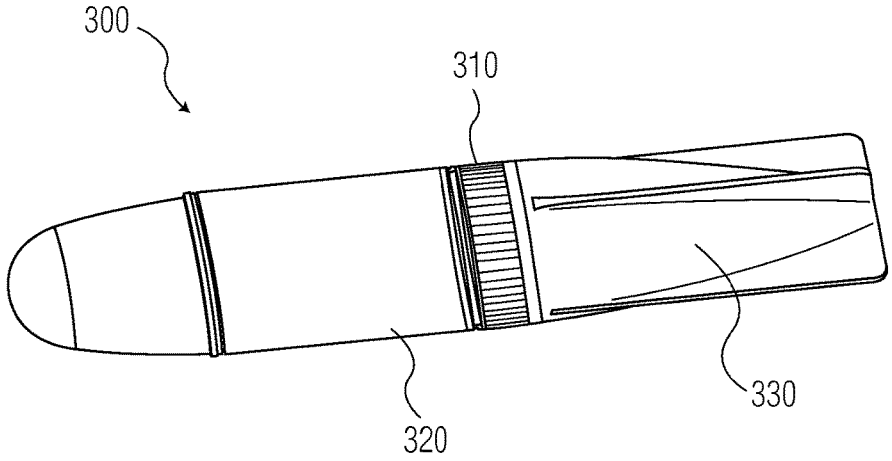
FIG. 5 is a model of a new 40 mm extended range high performance projectile (300) according to the invention with rocket assist (rocket not shown) and guidance navigation and control (GN&C) capability (previously described) and having a spin decoupling device 310.

FIG. 5 is a model of a new 40 mm Extended Range High Performance Projectile (300) with Rocket Assist (rocket not shown) and Guidance navigation and Control (GN&C) Capability (previously described) and decoupling device 310. Decoupling device 310 (which is like element 120 or spinner 708) allows for the front end of the projectile (320) to not spin while traveling down range but still allow for the rear end of the projectile 330 to independently spin to enhance flight stability and produce clearer camera coverage. The effects of spinning the rear end could aid in nullifying asymmetries created by a rocket motor. An asymmetric burn can cause dispersion errors. Spin can average out these errors and thus improve flight stability.

FIG. 6 is a cutaway model of the new 40 mm Extended Range High Performance Projectile (460) loaded into cartridge case/sleeve (430). Cartridge case/sleeve (430) comprises a threaded closure plug (410) and a propellant spacer (420) to allow propellant to be evenly distributed at all angles in cup (440). Pusher/obturator plug (450) prevents gases from blowing past the projectile body and provides longer propellant pressure loading on the projectile, therefore providing the projectile (460) with higher velocity and lower standard deviation. Both of these help the projectile (460) hit targets consistently that are at much greater distances than capable in the prior art. Fins (such as 140 in FIG. 3, not shown here) would allow for true position and a riding surface to prevent balloting during launch cycle. A decoupling device (such as 310 in FIG. 5, not shown here) would allow for spin decoupling of sections of the round.

Figure 7A:
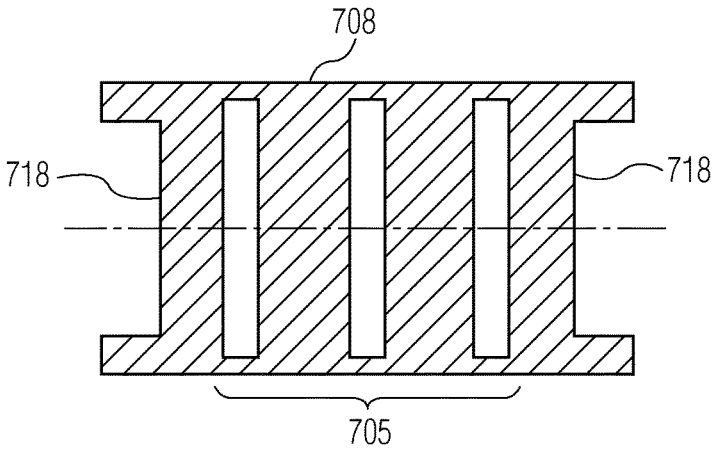
FIG. 7A shows cross section of the outer portion of a spin decoupling obturator device which might be used with this invention.
Figure 7B:
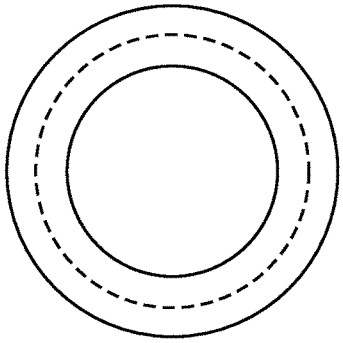
FIG. 7B shows an end view of FIG. 7A outer portion.
Figure 7C:
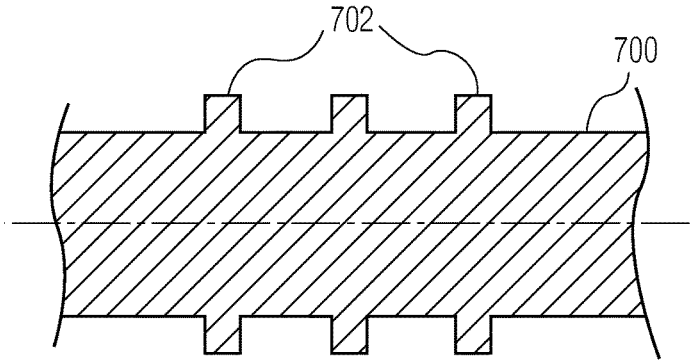
FIG. 7C shows a cross section of the inner portion of the obturator device, which inner portion will be located inside the FIG. 7A outer portion.
Figure 7D:
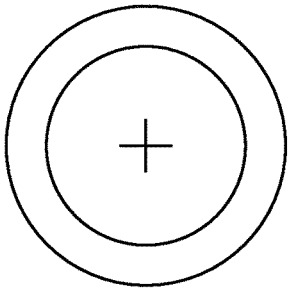
FIG. 7D shows an end view of inner portion FIG. 7C.
Figure 7E:
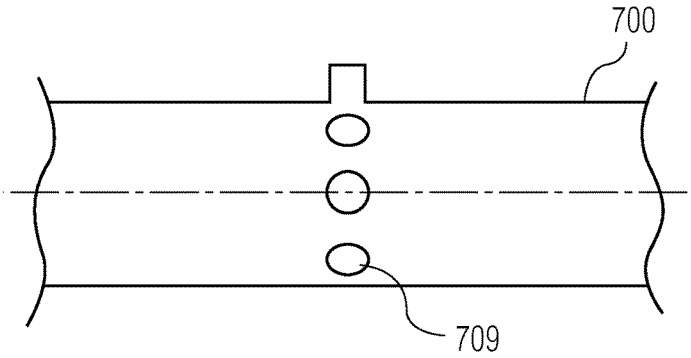
FIG. 7E shows an alternate inner portion for a spin decoupling obturator device for this invention.
Figure 7F:
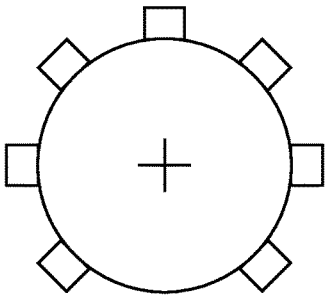
FIG. 7F shows an end view of the FIG. 7E inner portion.
Figure 7G:
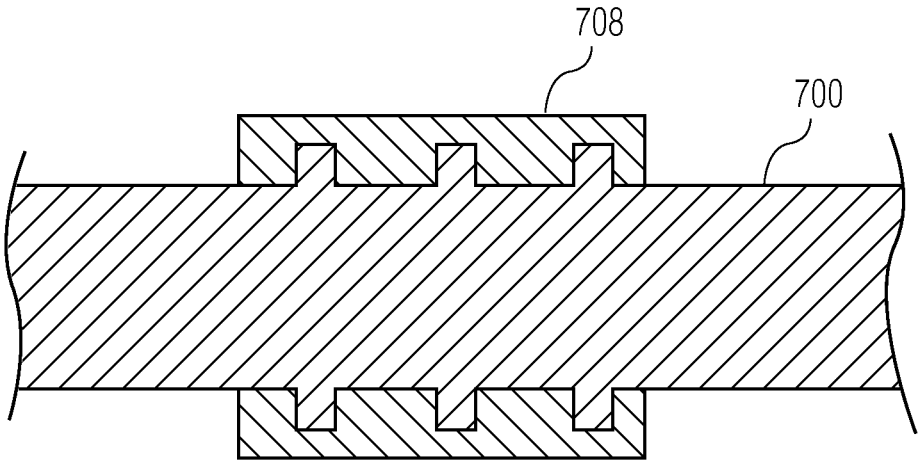
FIG. 7G shows a view of the inner portion FIG. 7A as mounted within the outer portion FIG. 7A obturator device.

In FIG. 7A there is generally shown a cross sectional cutaway view of a spinner device 708 of this invention, with side view FIG. 7B. Spinner 708 may be made as a hollow cylindrical shape of a plastic or other material. This spinner device has internal grooves 705 cut into its inner diameter surface. The internal grooves are meant to enclose elevated cylindrical ridges 702 (see FIG. 7C cross sectional view and its side view FIG. 7D; and see FIGS. 7G and 7H) or even just a series of elevated bumps 709 randomly or in a track (see external surface view FIG. 7E, and its side view FIG. 7F), upon the cylindrical surface 700 of an ammunition round according to this invention. There might (or might not) be a number of elevated bump tracks like 709, one for each groove of 705 for example. Spinner device 708 might require some flexibility to be installed onto the elevated ridges 702 or bumps 709. The spinner might have to be pulled over the elevated ridges or bumps on surface 700 of the round when manufactured. One of the side openings 718 might have to stretch enough to receive the elevated ridges or bumps on surface 700, until some or all of the elevated ridges or bumps come to rest in grooves 705. A plastic material spinner might thus work well if it is somewhat stretchable, yet still be sufficiently resilient when put into position to perform its spinning function. Of course, there are possible many other materials for a spinner or methods of manufacturing a spinner already in position on a round according to this invention. It might conceivably even be molded in place in some fashion. Most important to point out is that the grooves do not advance the spinner over any distance at all the way a screw thread might advance along the length of a central axis when turned. Rather, the grooves are intended to have spinning around 360 degrees without advancing at all, i.e., to just spin in place around a central axis of the round where the spinner is installed. This will become more apparent when viewing the mating cylindrical surface 700 in FIG. 7C or 7E, meant to have mating external elevated ridges or elevated bumps to ultimately hold the spinner 708 attached onto such cylindrical surface. This allows spinner 708 to spin freely around 360 degrees, and not to advance at all in distance based on such spinning. In other words, surface 700 holds spinner 708 just right in its place. The cross sectional shapes, heights, number and positioning of grooves, ridges or bumps have numerous possible choices and possibilities, to mate a spinner over a round's surface and yet to let it freely spin 360 degrees without advancing any distance longitudinally. There may be no need of any grooves at all. In some cases if the spinner is seated in the round in an indented seat, then even ridges or bumps might also not even be needed to have a free spinning, spinner device permanently positioned on a round. The outer external surface of the spinner may have many shapes; it may be smooth, have channels, have grooves to assist in engaging the grenade launcher's rifling, knurled shapes, or many other possibilities. Such surfaces ideally are meant to be readily engaged by the internal rifling of the grenade launcher device, such as found in the M320, e.g.

Figure 7H:
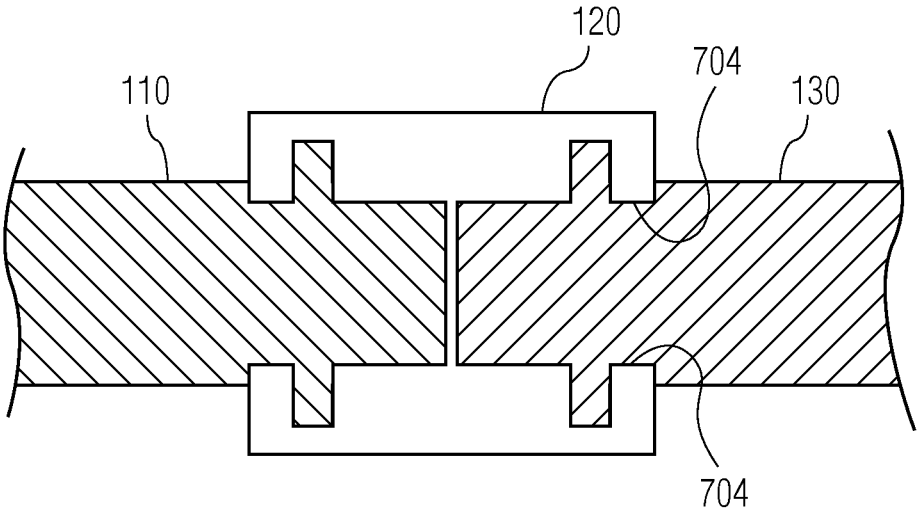
FIG. 7H shows a yet further obturating device which further serves to couple together two spinning shafts 110 and 130 as well as to allow these two shafts to spin freely.

The spinner can also serve a second feature that it can also to be used to couple two separate, independently spinning/non spinning parts of a round, such as its use as a decoupling device 310 in FIG. 5 which joins together the round's front end 320 and rear end 330; see also FIG. 7H where front section 110 and independent rear section 130, are both coupled together within a spinner 120, which sits in a cylindrical recessed area 704 made out of the smaller diameter at ends of both 110 and 130. Though coupled, yet all parts can spin independently, and so can the spinner itself spin independently. While 310 may join and hold these parts together, yet any of 320 and 330 or 310 may spin/not spin, independently of the others. Either 320 or 330 may spin on its own side of the decoupling device 310, inside the decoupling device 310. Also, 310 overall serves as a spinner for the entire round so the round itself cannot be engaged by the internal rifling in the launcher, except that the decoupling device 310 itself might still be so engaged by the internal rifling. The coupling in FIG. 7H may be accomplished by snapping together 110 and 130, with 120 in the middle.

There are numerous other shapes, dimensions, and arrangements for coupling spinners possible.

Desirable features of note in these described inventions, include the following: New aerodynamic 40 mm low velocity projectiles (100, 200, 300, and 460) are shown that can be fired from a M320 weapon and travel to more than 800 meters compared to a present 40 mm M433 ammunition with a range of just 400 meters. New, aerodynamic 40 mm low velocity projectiles (100, 200, 300 or 460) are shown that do not need spin or spring loaded deployable fins, (but do have stationary tapered fins such as 330), and which can be fired from an M320 gun and travel to over 800 meters. A new aerodynamic 40 mm low velocity projectile (300) is shown that can have the front of the projectile (320) not spin while traveling to a target, while the back end (330) may independently spin, to enhance aerodynamic stability. A new Aerodynamic 40 mm low velocity projectile (300) is shown where the front end (320) does not spin, allowing for a camera system or Semi-Active Laser (SAL) designator, and a smaller low cost Guidance Navigation and Control (CAS) System, to be employed therein. A new Aerodynamic 40 mm low velocity projectile is shown with back end (330) that can spin or not spin at any rate set by canting the fins (140). Decoupling mechanism (310) can be optional and can allow the front end (320) to not spin. A new aerodynamic 40 mm low velocity projectile is shown with the ability to be fired from an M320 rifled using decoupling mechanism and slip obturator (310) or placed in a smooth bore sleeve and fired from an M320 with no spin. A new aerodynamic 40 mm low velocity projectile is shown with ability to have rocket assist (not shown) and to travel to over 2000 meters. A new aerodynamic 40 mm low velocity projectile is shown with electronics and autopilot function (240) tied into a GN&C system for guide to target capability. A new aerodynamic 40 mm low velocity projectile is shown with stationary fins (140) that allow for slide fit fins placed into a smooth bore sleeve for true position and lack of balloting.

A propellant spacer (420) can be added to the sleeve which can allow the propellant load to remain in an upright position at all angles, and to provide for balanced ignition, and to eliminate tip up of a projectile after leaving the M320 gun. A rear mounted pusher/obturator plug (450) is shown that prevents gases from blowing past, to provide longer propellant pressure loading on a projectile (100, 200, 300 or 400), and therefore providing a projectile (460) with higher velocity and low standard deviation. A projectile (100, 200, 300 or 400) is shown which can be 2-7 inches in length, and which can be fired from an M320 launcher gun. A projectile is shown, providing fins (140) that can be made of multiple materials including copper, aluminum, steel and/or prestressed metals for fragmentation capability. The projectile may provide 2-8 fins in an assembly (140) depending on decision for aero ballistic balance of a projectile (such as 100, 200, 300 or 400). The ammunition round can be used/reused for target training with fluorescent powder in the body and nose, imitating an explosion and tactical use.

While the invention may have been described with reference to certain embodiments, numerous changes, alterations and modifications to the described embodiments are possible without departing from the spirit and scope of the invention as defined in the appended claims, and equivalents thereof.

What is claimed is:

1. An extended range, guided, in-bore 40 mm ammunition round (100) having a projectile, which round can be fired from an M203 or an M320 grenade launcher without incurring any spin on said projectile imparted by said M203 or M320 grenade launcher during said launching, wherein said projectile comprises a projectile body having a front end with a nose section (110), and a rear end thereof (130), and wherein said projectile further includes an obturator-means (120) coupling said front end to said rear end of said projectile body, and further wherein said rear end includes a stabilizing fin assembly (140) with a number of fins, optionally canted for low rate or no spin, and whereas said obturator means, stabilizing fin assembly and front end, are all spinnably decoupled from one another, and;

wherein the outside diameter of said obturator means is made wider than the outside diameter of both said projectile or said fin assembly, and;

wherein the projectile front end and rear end are both coupled by being snapped in to said obturator means, and;

wherein said round, for launching, is loaded into a sleeve (430), said sleeve comprising a propellant cup (440) to enhance the range.

2. The ammunition round of claim 1 wherein the nose section comprises a camera (210), and a tactical guidance navigation system (240) with control canard activation system (230).

3. The ammunition round of claim 1 wherein the overall outer contour of the round is football-like shaped, with the spinning obturator means being as the widest diameter on the round.

4. The ammunition round of claim 1 where blades on said fins have a canted angle to relatively slowly spin up the projectile during firing.

5. The ammunition round of claim 1 wherein the number of fins are between 2 and 8.

6. The ammunition round of claim 1 wherein the obturator means has snapped in, groove features and wherein said round has several elevated bump grooves on the projectile and also on the fin assembly, to aid in keeping said obturator means in place.

7. The ammunition round of claim 1 wherein the round has a rocket assist feature.

8. The ammunition round of claim 1 wherein the projectile is 2 to 7 inches in length.

9. The ammunition round of claim 1 having an explosive payload in the body and nose which includes any of: selected energetic materials, an explosive liner, fragmentation projectiles or a selected warhead.

10. The ammunition round of claim 1 used or reused for target training with fluorescent powder in the body and nose, imitating an explosion and tactical use.

* * * * *